United States Patent [19]

Bryant

[11] Patent Number: 4,591,725

[45] Date of Patent: May 27, 1986

[54] SYSTEM FOR AMPLIFYING ALL FREQUENCIES DETECTED FROM A FLAME DETECTOR

[76] Inventor: Jack A. Bryant, 500 Main St., Melrose, Mass. 02176

[21] Appl. No.: 545,440

[22] Filed: Oct. 26, 1983

[51] Int. Cl.[4] ..... G08B 17/12

[52] U.S. Cl. ..... 250/554; 250/214 A; 328/6; 340/578; 431/79

[58] Field of Search ..... 250/554, 214 A, 214 AG, 250/214 SW, 214 R, 206; 137/65; 340/578; 431/79; 307/311, 351, 264; 328/6

[56] References Cited

U.S. PATENT DOCUMENTS 3,995,221 11/1976 MacDonald ..... 340/578
4,370,557 1/1983 Axmark et al. ..... 340/578
4,395,638 7/1983 Cade ..... 250/554

FOREIGN PATENT DOCUMENTS 2631454 1/1978 Fed. Rep. of Germany ..... 340/578

*Primary Examiner*—Edward P. Westin
*Attorney, Agent, or Firm*—Russell & Tucker

[57] ABSTRACT

A fail-safe, self-checking flame monitoring circuit is provided without the use of a mechanical shutter in which a photodetector provides a signal corresponding to flame intensity (including flicker), an amplifier amplifies the signal, the amplification is controlled by a negative feedback circuit in relation to the peak amplitude of the signal (including flicker) such that all frequencies down to DC are amplified equally, and all amplified signals are passed, without threshold, downstream for further processing.

6 Claims, 2 Drawing Figures

SYSTEM FOR AMPLIFYING ALL FREQUENCIES DETECTED FROM A FLAME DETECTOR

FIELD OF THE INVENTION

The present invention relates to fail-safe equipment for monitoring flames in fire boxes of boilers, incinerators, and the like. More particularly, it relates to the detection and fail-safe amplification of signals from a flame monitoring photo-detector, without the use of a mechanical shutter.

BACKGROUND OF THE INVENTION

The conventional way to provide fail-safe flame monitoring is to employ a mechanical shutter which interrupts the passage of light from the flame to a photocell at a predetermined rate of interruption. In this way, a "flame-on" condition will be indicated only by signals from the photocell occurring at the predetermined rate. Any other response from the photocell will indicate either a "flame out" condition or an equipment failure, and, in order to be safe, the burner system will be shut down to determine what the problem is. This is what is meant by the term "fail-safe".

Mechanical shutters, however, have numerous drawbacks. They have a motor drive and moving parts, which can give trouble. The bearings also are a problem, especially in the portions nearest the flame where the heat is greatest and lubrication is difficult. They take up space, they are labor-intensive, and, therefore, expensive to install. All of these factors contribute to their high initial cost and high cost of maintenance. It is, therefore, a general objective of this invention to provide a flame monitoring equipment, which is fail-safe but which eliminates the mechanical shutter.

Another problem encountered in modern flame monitoring, is the detection of flames in the presence of smoke, pulverized coal, dirt, ash or other adverse condition which may be associated with the flame in a firebox. In this connection, a high degree of sensitivity is desireable along with full fail-safeness. Accordingly, the provision of high sensitivity together with full fail-safeness is a further object of the invention.

BRIEF DESCRIPTION OF THE INVENTION

In the accomplishments of these and other objects of the invention, in a preferred embodiment thereof, a photovoltaic light detector (silicon diode) is employed to generate a signal in response to light impinging upon it. When that light comes directly from the axial midportion of a flame, the intensity of the light will vary according to a "flicker frequency" and, therefore, the signal from the detector has the flicker frequency superimposed on it. The signal is then amplified by a circuit which responds extremely rapidly and applies maximum amplification to all signals up to a given value. Above that value the amplification is gradually reduced so as to avoid saturation of the amplifier. The reduction of amplification is accomplished by a feedback circuit which establishes a maximum amplification for the peak amplitude of the signals from the detector (including flicker). In this way, all frequencies down to D.C. (including flicker frequency as well as D.C.) are amplified equally. The signals are then processed further downstream in order to isolate the flicker frequencies for the purpose of indicating a "flame-on" condition in the conventional manner.

It is a feature of the invention that the signals from the detector are switched on and off by means of a switch located between the detector and the amplifier, which is operated by a timer designed, in a preferred embodiment to close the switch for 800 m/sec (milliseconds) every second. This provides an interrupted signal from the detector which is virtually the same as that provided by conventional shutters and provides complete self-checking for all components in the system but for the photodetector which, being photovoltaic, can only fail in a non-conducting mode. Thus, the system is rendered "fail-safe" without the use of a mechanical shutter.

It is a feature of the invention that the presence or absence of a flicker frequency in the output provides additional self-checking.

Still another feature of the invention is that the rapidity of the response and the maximum amplification of all signals up to the given value, assures maximum sensitivity and permits the detection of low intensity and "dirty" flames.

A further feature in one embodiment of the invention relates to interrupting the signal from the detector by means of a variable resistance whereby the signal is applied gradually to the amplifier so as to avoid saturation of the amplifier which otherwise results from the instantaneous application of the full flame signal to the amplifier.

Further objects and features will be understood from the following description.

BRIEF DESCRIPTION OF THE DRAWINGS

The preferred embodiments herein shown are depicted in the accompanying drawings in which.

DETAILED DESCRIPTION OF THE INVENTION

A preferred embodiment of the invention comprises a silicon diode photovoltaic light detector D1 appropriately arranged in the conventional manner in an optical system (not shown) to view along the center axis of a flame so as to provide flicker frequencies when a flame is present. D1 generates a current whenever light strikes it, the value of the current being proportional to the intensity of the light.

The circuit comprises the outputs of the photo detector D1 applied via a FET Analog Switch S1 to the input terminals of a FET Input Operational Amplifier U1. The output of U1 is connected directly to a capacitor C3 (0.047 uf) which provides an AC output for the system. A feedback network for controlling the amplification of U1, comprises an R/C combination R1 (330k) and C1 (100 pf), and an N-channel J FET (J Field Effect Transistor) Q1 in series with a resistor R2 (1k); with the RC combination, and Q1, R2 combination connected respectively in parallel between the output and the negative input of U1. The feedback network is controlled by a low voltage varistor V1, which is connected between the output of U1 and the center tap of a voltage divider R3 (1 meg), R4 (1 meg) and ground. The center tap of the voltage divider also is connected through FET Analog Switch S2 to the gate of Q1. A capacitor C2 (4.7 uf) is also connected between the gate of Q1 and ground.

Figure 1:
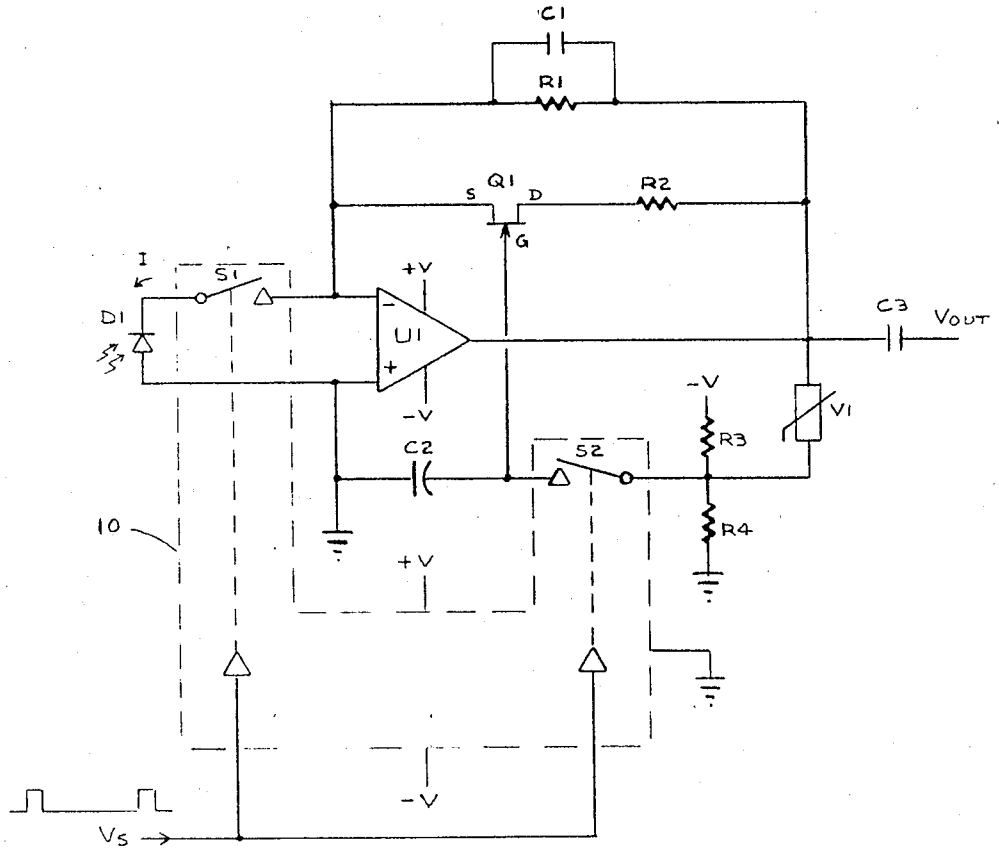
FIG. 1 is a schematic of the circuit of the invention showing switches for providing self-checking.

Switches S1 and S2 are indicated by the dotted lines in FIG. 1 designated 10 and comprise dual FET Analog simultaneously acting switches. They are controlled by a timer, not shown, to be closed for 800 m/second opened for 200 m/sec to simulate the operation of a conventional mechanical shutter. The on-off period is a matter of choice. The only reason 800 m/s−200 m/s is chosen here is that such timing is required in West Germany.

When the switches S1, S2 are closed, signals from D1 are amplified by U1 at full amplification until an output peak voltage of U1 of about +3 volts is reached, at which point V1 commences conducting, and the voltage at the gate of Q1 rises (becomes more positive) causing Q1 to conduct and thereby reduce the amplification of Q1. The resistance of V1 drops increasingly as the output voltage of U1 rises, thereby causing the negative feedback to prevent peak amplification by U1 greater than about 8 volts. When the signal from D-1 diminishes, however, the resistance of V1 very rapidly increases proportionally and capacitor C2 causes the voltage at the gate of Q1 to remain substantially constant. When switch S2 opens, the charge on C2 remains unchanged, but when switch S2 is closed, the charge on C2 gradually diminishes (becomes more negative) when the output of U1 is low. In this way. the amplification of U1 is controlled by the peak value of the signals from D1, and all frequencies down to DC are amplified equally. The AC output at C3, therefore, contains all frequencies detected by D1, equally amplified. The "flicker" frequencies which indicate a flame-on condition, are separated from the very low frequencies by conventional filtering components further downstream.

The circuit is extremely sensitive because it has no minimum threshold. It amplifies and transmits downstream all detectable signals. Its extremely rapid response also protects U1 from heavy saturation from transients of more than about 500 u/sec duration. The periodic switching of S1 provides full self-checking throughout the system, and since D1 is photovoltaic, it can only fail in the off mode. Thus, the system is completely fail-safe.

Figure 2:
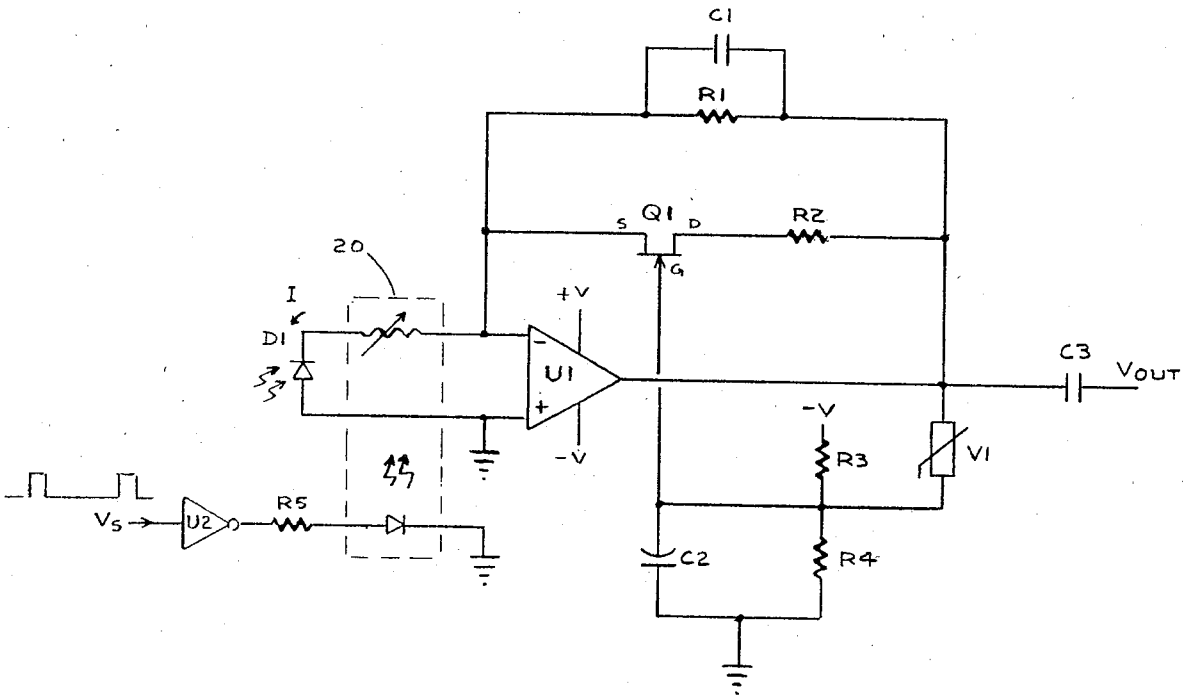
FIG. 2 is a schematic of the circuit of the invention showing a variable resistance form of switch.

In the embodiment of FIG. 2, an LED/CdS photocoupler is employed as a switch indicated within the dotted lines 20. A timer operates the photocoupler 20 through an inverting amplifier U2 and current limiting resistor R5. The photocoupler acts as a variable resistance with a gradual rise from an "off" condition to an "on" condition within approximately 50 m/s. The advantage of this is to apply the signal from D1 to U1 gradually and, thereby to avoid the saturation (and consequent ringing) of U1, which the quick closure of S1 (or of a mechanical shutter) causes. This provides an increase in the useful period of flame observation, and, thereby, increasing the efficiency of the system.

The time constant established by C2 and R3, R4 is such that the highest peak signal from D1 over a substantial period controls the amplification of U1, and in the circuit shown, if the signals at D1 cease,the amplification of U1 will not regain maximum amplification for about 500 m/sec (milliseconds). This period, however, can be varied depending upon conditions. Thus, if a quicker return to high sensitivity is desired, the recovery rate can be shortened by decreasing the value of C2. On the other hand, it is important for the operation of the circuit that the negative feedback network limit the amplification of U1 in response to the peak value of signals from D1 over a substantial period of, at least, about 100 m/sec so as to allow equal amplification of virtually all frequencies.

In view of the preferred embodiments herein described, those skilled in the art will now recognize that variations can be made without departing from the spirit of the invention, and, therefore, it is not intended to confine the invention to the precise form herein shown but rather to limit it solely in terms of the appended claims.

I claim:

1. A flame monitoring circuit comprising:

(a) a detector for providing a direct current electrical signal, which varies in proportion to the intensity of the light striking the detector;

(b) an amplifier for amplifying the signal of said detector;

(c) a negative feedback network for controlling the gain of said amplifier in response to the highest peak value of the signal of said detector over a substantial period adapted to allow the amplification of all frequencies down to D.C., including flicker frequency, equally; and, (d) means for transmitting all frequencies detected by said detector downstream for further processing.

2. The flame monitoring circuit defined in claim 1 further characterized by:

(e) said negative feedback network comprising a J Field Effect Transistor whose resistance is controlled by a varistor.

3. The flame monitoring circuit defined in claim 1 further characterized by:

(f) a switch between said detector and said amplifier; and, (g) a timer for periodically opening and closing said switch to provide self-checking for the system.

4. The flame monitoring circuit of claim 3 further characterized by:

(h) said detector being photovoltaic and thereby fail-safe.

5. The flame monitoring circuit defined in claim 3 further characterized by:

(i) said switch being a slow acting photocoupler.

6. The flame monitoring circuit defined in claim 3 further characterized by:

(j) said switch being an LED/CdS photocoupler.

* * * * *